US005947280A

United States Patent [19]

Jimenez

[11] Patent Number: 5,947,280

[45] Date of Patent: Sep. 7, 1999

[54] CIGARETTE CONTAINER WITH CUTTING DEVICE

[76] Inventor: Angelo Jimenez, 25869 Patricia, Warren, Mich. 48091

[21] Appl. No.: 09/065,196

[22] Filed: Apr. 23, 1998

[51] Int. Cl.[6] ..... B65D 69/00; A24F 13/20

[52] U.S. Cl. ..... 206/238; 206/236; 131/248; 30/113

[58] Field of Search ..... 206/236, 238; 131/248; 30/113, 111

[56] References Cited

U.S. PATENT DOCUMENTS

| | | | |
|---|---|---|---|
| 317,980 | 5/1885 | Dixion | 30/111 |
| 1,021,849 | 4/1912 | Schwieger | 206/238 |
| 1,166,881 | 1/1916 | Anderson | 30/113 |
| 1,249,105 | 12/1917 | Johnson | 206/238 |
| 2,139,838 | 12/1938 | Mayer | 131/248 |
| 2,491,958 | 12/1949 | Dunn | 206/238 |
| 2,664,091 | 12/1953 | Thostenson | 206/238 |
| 5,819,753 | 10/1998 | Birkenthal | 131/248 |

*Primary Examiner*—Paul T. Sewell
*Assistant Examiner*—J. Mohandesi

[57] ABSTRACT

A new cigarette container with cutting device for cutting off the lit end of a cigarette off so that the remainder of the cigarette may be stored in the container to be smoked later. The inventive device includes a base portion, a top, a bottom and a perimeter side wall extending between the top and bottom of the base portion. The perimeter side wall of the base portion defines an interior space of the base portion adapted for holding cigarettes therein. The top of the base portion has an opening into the interior space of the base portion. A lid portion substantially closes the opening of the top of the base portion. The lid portion is hingedly coupled to the base portion. A cigarette cutting portion is extended from the bottom of the base portion. The cigarette cutting portion comprises a cutting blade and a sliding portion.

9 Claims, 2 Drawing Sheets

CIGARETTE CONTAINER WITH CUTTING DEVICE

BACKGROUND OF THE INVENTION

1. Field of the Invention

The present invention relates to accessories for cigarettes and more particularly pertains to a new cigarette container with cutting device for cutting off the lit end of a cigarette off so that the remainder of the cigarette may be stored in the container to be smoked later.

2. Description of the Prior Art

The use of accessories for cigarettes is known in the prior art. More specifically, accessories for cigarettes heretofore devised and utilized are known to consist basically of familiar, expected and obvious structural configurations, notwithstanding the myriad of designs encompassed by the crowded prior art which have been developed for the fulfillment of countless objectives and requirements.

Known prior art accessories for cigarettes include U. S. Pat. No. 5,377,696; U.S. Pat. No. 4,160,318; U.S. Pat. No. 4,660,575; U.S. Pat. No. 5,345,952; U.S. Pat. No. 3,107,674; and U.S. Pat. No. 1,538,522.

While these devices fulfill their respective, particular objectives and requirements, the aforementioned patents do not disclose a new cigarette container with cutting device. The inventive device includes a base portion, a top, a bottom and a perimeter side wall extending between the top and bottom of the base portion. The perimeter side wall of the base portion defines an interior space of the base portion adapted for holding cigarettes therein. The top of the base portion has an opening into the interior space of the base portion. A lid portion substantially closes the opening of the top of the base portion. The lid portion is hingedly coupled to the base portion. A cigarette cutting portion is extended from the bottom of the base portion. The cigarette cutting portion comprises a cutting blade and a sliding portion.

In these respects, the cigarette container with cutting device according to the present invention substantially departs from the conventional concepts and designs of the prior art, and in so doing provides an apparatus primarily developed for the purpose of cutting off the lit end of a cigarette off so that the remainder of the cigarette may be stored in the container to be smoked later.

SUMMARY OF THE INVENTION

In view of the foregoing disadvantages inherent in the known types of accessories for cigarettes now present in the prior art, the present invention provides a new cigarette container with cutting device construction wherein the same can be utilized for cutting off the lit end of a cigarette off so that the remainder of the cigarette may be stored in the container to be smoked later.

The general purpose of the present invention, which will be described subsequently in greater detail, is to provide a new cigarette container with cutting device apparatus and method which has many of the advantages of the accessories for cigarettes mentioned heretofore and many novel features that result in a new cigarette container with cutting device which is not anticipated, rendered obvious, suggested, or even implied by any of the prior art accessories for cigarettes, either alone or in any combination thereof.

To attain this, the present invention generally comprises a base portion, a top, a bottom and a perimeter side wall extending between the top and bottom of the base portion. The perimeter side wall of the base portion defines an interior space of the base portion adapted for holding cigarettes therein. The top of the base portion has an opening into the interior space of the base portion. A lid portion substantially closes the opening of the top of the base portion. The lid portion is hingedly coupled to the base portion. A cigarette cutting portion is extended from the bottom of the base portion. The cigarette cutting portion comprises a cutting blade and a sliding portion.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new cigarette container with cutting device apparatus and method which has many of the advantages of the accessories for cigarettes mentioned heretofore and many novel features that result in a new cigarette container with cutting device which is not anticipated, rendered obvious, suggested, or even implied by any of the prior art accessories for cigarettes, either alone or in any combination thereof.

It is another object of the present invention to provide a new cigarette container with cutting device which may be easily and efficiently manufactured and marketed.

It is a further object of the present invention to provide a new cigarette container with cutting device which is of a durable and reliable construction.

An even further object of the present invention is to provide a new cigarette container with cutting device which is susceptible of a low cost of manufacture with regard to both materials and labor, and which accordingly is then susceptible of low prices of sale to the consuming public, thereby making such cigarette container with cutting device economically available to the buying public.

Still yet another object of the present invention is to provide a new cigarette container with cutting device which provides in the apparatuses and methods of the prior art some of the advantages thereof, while simultaneously overcoming some of the disadvantages normally associated therewith.

Still another object of the present invention is to provide a new cigarette container with cutting device for cutting off the lit end of a cigarette off so that the remainder of the cigarette may be stored in the container to be smoked later.

Yet another object of the present invention is to provide a new cigarette container with cutting device which includes a base portion, a top, a bottom and a perimeter side wall extending between the top and bottom of the base portion. The perimeter side wall of the base portion defines an interior space of the base portion adapted for holding cigarettes therein. The top of the base portion has an opening into the interior space of the base portion. A lid portion substantially closes the opening of the top of the base portion. The lid portion is hingedly coupled to the base portion. A cigarette cutting portion is extended from the bottom of the base portion. The cigarette cutting portion comprises a cutting blade and a sliding portion.

Still yet another object of the present invention is to provide a new cigarette container with cutting device that, with the rising cost of cigarettes, allows smokers to save a cigarette they are unable to finish smoking in one sitting to save the cigarette for a later time rather than wasting the unfinished part of the cigarette.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
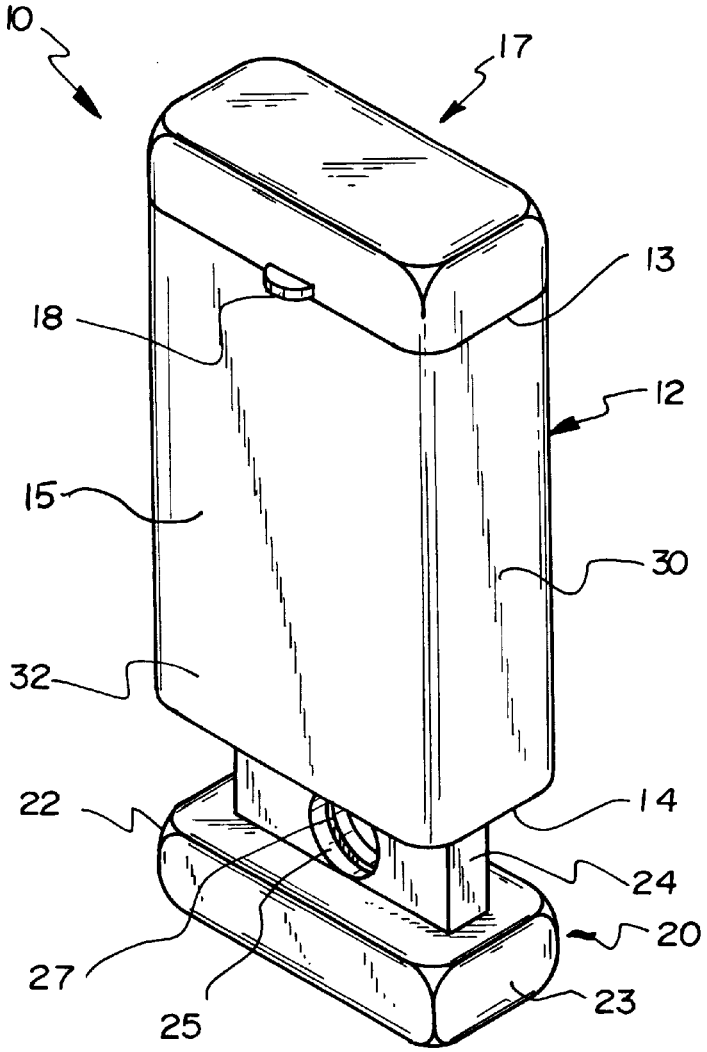
FIG. 1 is a schematic perspective view of a new cigarette container with cutting device according to the present invention.
Figure 2:
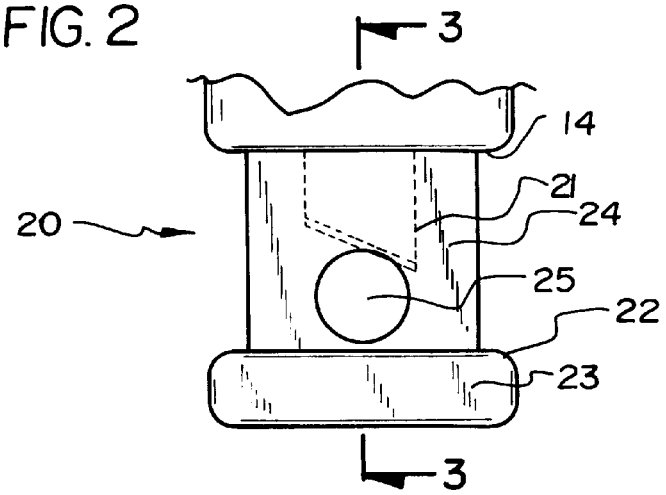
FIG. 2 is a schematic side view of the cutting portion of the present invention.

With reference now to the drawings, and in particular to FIGS. 1 through 4 thereof, a new cigarette container with cutting device embodying the principles and concepts of the present invention and generally designated by the reference numeral 10 will be described.

As best illustrated in FIGS. 1 through 4, the cigarette container with cutting device 10 generally comprises a base portion 12, a top 13, a bottom 14 and a perimeter side wall 15 extending between the top 13 and bottom 14 of the base portion 12. The perimeter side wall 15 of the base portion 12 defines an interior space of the base portion 12 adapted for holding cigarettes therein. The top 13 of the base portion 12 has an opening 16 into the interior space of the base portion 12. A lid portion 17 substantially closes the opening 16 of the top 13 of the base portion 12. The lid portion 17 is hingedly coupled to the base portion 12. A cigarette cutting portion 20 is extended from the bottom 14 of the base portion 12. The cigarette cutting portion 20 comprises a cutting blade 21 and a sliding portion 22.

In closer detail, the base portion 12 is generally rectangular and has a generally rectangular top 13, a generally rectangular bottom 14 and a perimeter side wall 15 extending between the top 13 and bottom 14 of the base portion 12. The perimeter side wall 15 of the base portion 12 has a pair of generally rectangular end panels 30,31 and a pair of generally rectangular side panels 32,33 extending between the end panels 30,31 of the perimeter side wall 15. The perimeter side wall 15 of the base portion 12 defines an interior space of the base portion 12 adapted for holding cigarettes therein. The top 13 of the base portion 12 has an opening 16 into the interior space of the base portion 12. The opening 16 of the top 13 of the base portion 12 preferably has a generally rectangular periphery.

The lid portion 17 is generally rectangular and substantially closes the opening 16 of the top 13 of the base portion 12. The lid portion 17 is hingedly coupled to the base portion 12. Preferably, the lid portion 17 has a latch tab 18 for releasably closing the lid portion 17 over the opening 16 of the top 13 of the base portion 12.

The cigarette cutting portion 20 extends from the bottom 14 of the base portion 12. The cigarette cutting portion 20 includes a cutting blade 21 and a sliding portion 22. The cutting blade 21 is downwardly extended from the bottom 14 of the base portion 12. The sliding portion 22 has an generally rectangular end portion 23 and an insertion portion 24. The insertion portion 24 of the sliding portion 22 has an interior and a generally circular bore 25 therethrough. The bore 25 is designed for inserting a cigarette therethrough so that the cigarette may be cut by the cutting blade. The insertion portion 24 is slidably inserted into an annular slot 26 in the bottom 14 of the base portion 12 such that the cutting blade 21 extends into the interior of the insertion portion 24.

Figure 3:
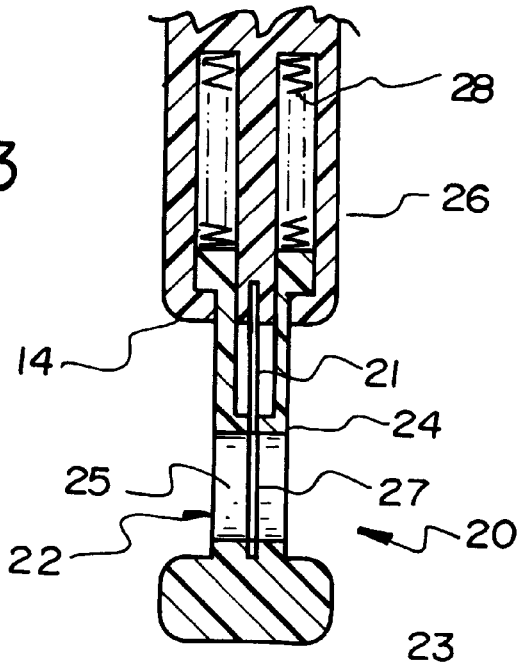
FIG. 3 is a schematic sectional view of the cutting portion of the present invention taken from line 3—3 of FIG. 2.
Figure 4:
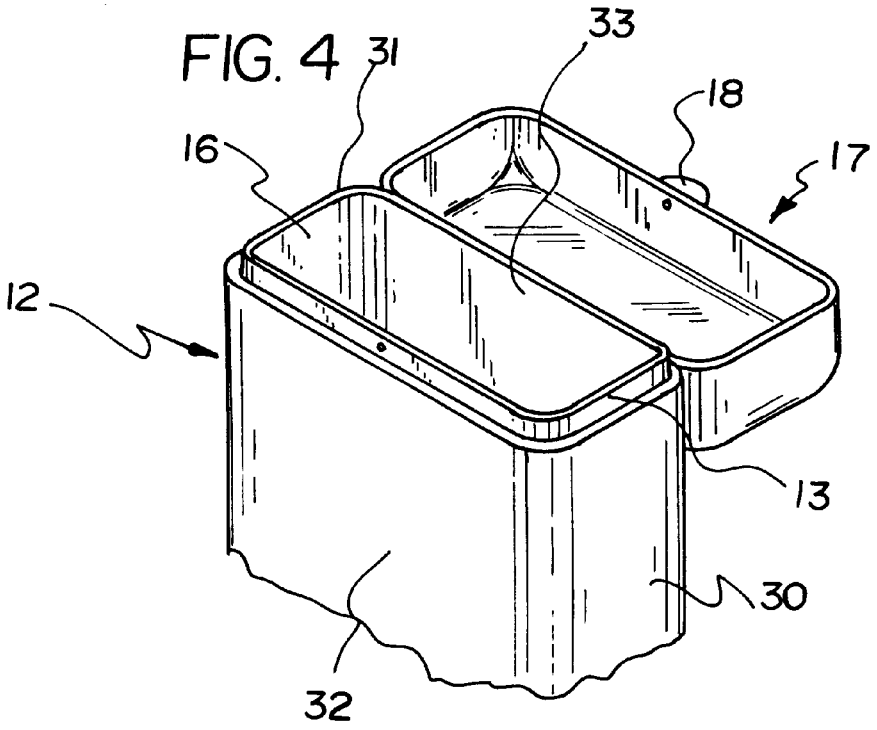
FIG. 4 is a schematic perspective view of the opening of the top of the base portion of the present invention.

The insertion portion 24 of the sliding portion 22 is slidable in the base portion 12 with respect to the cutting blade 21 between a first position and a second position. When the insertion portion 24 of the sliding portion 22 is in the first position, the cutting blade 21 extends into the bore 25 of the insertion portion 24. As illustrated in FIG. 3, the bore 25 of the insertion portion 24 is positioned between the cutting blade 21 and the end portion 23 when the insertion portion 24 of the sliding portion 22 is in the second position. Preferably a pair of grooves 27 on the sides of the bore help properly guide the cutting blade as it transverses the bore.

Preferably, the insertion portion 24 of the sliding portion 22 is biased towards the second position. Ideally, a spring 28 in the annular slot 26 biases the insertion portion 24 of the sliding portion 22 toward the second position. In use, the end portion 23 is designed for holding or pushing against to slide the insertion portion 24 of the sliding portion 22 towards the first position.

In an ideal illustrative embodiment, the length of the container is greater than about 4 inches from between the lid portion 17 and the end portion 23. In this ideal illustrative embodiment, the base portion 12 has a length defined between the top 13 and bottom 14 of the base portion 12 preferably greater than 2 inches and ideally, about 3¼ inches. The base portion 12 has a width defined between the end panels 30, 31 of the perimeter side wall 15 of the base which is preferably greater than about 1 inch. In the illustrative embodiment, the base portion 12 has a depth defined between the side panels 32, 33 of the perimeter side wall 15 of the base greater than about ½ inch.

In use, a user inserts the lit end of a cigarette through the bore and slides the sliding portion so that the cutting blade cuts off the lit end of the cigarette from the rest of the cigarette. The now shortened cigarette may be stored in the interior space of the base portion to be smoked at a later time.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A container for holding cigarettes, comprising:

a base portion, a top, a bottom and a perimeter side wall extending between said top and bottom of said base portion;

said perimeter side wall of said base portion defining an interior space of said base portion adapted for holding cigarettes therein;

said top of said base portion having an opening into said interior space of said base portion;

a lid portion substantially closing said opening of said top of said base portion, said lid portion being hingedly coupled to said base portion; and a cigarette cutting portion being extended from said bottom of said base portion, said cigarette cutting portion comprising a cutting blade and a sliding portion; and said sliding portion having a generally circular bore therethrough, said sliding portion being slidably inserted into said bottom of said base portion such that said cutting blade is positioned a long said bore of said sliding portion such that an object placed through said bore is cut when said sliding portion is slid along said cutting blade.

2. The container of claim 1, wherein said perimeter side wall of said base portion has a pair of end panels and a pair of side panels extending between said end panels of said perimeter side wall, said base portion having a length defined between said top and bottom of said base portion, said base portion having a width defined between said end panels of said perimeter side wall of said base, and said base portion having a depth defined between said side panels of said perimeter side wall of said base.

3. The container of claim 2, wherein said length of said base portion is greater than 2 inches, wherein said width of said base portion is greater than about 1 inch, and wherein said depth of said base portion is greater than about ½ inch.

4. A container for holding cigarettes, comprising:

a base portion, a top, a bottom and a perimeter side wall extending between said top and bottom of said base portion;

said perimeter side wall of said base portion defining an interior space of said base portion adapted for holding cigarettes therein;

said top of said base portion having an opening into said interior space of said base portion;

a lid portion substantially closing said opening of said top of said base portion, said lid portion being hingedly coupled to said base portion;

a cigarette cutting portion being extended, from said bottom of said base portion, said cigarette cutting portion comprising a cutting blade and a sliding portion;

said cutting blade being extended from said bottom of said base portion;

said sliding portion having an end portion and an insertion portion;

said insertion portion of said sliding portion having an interior and a generally circular bore therethrough, said insertion portion being slidably inserted into said bottom of said base portion such that said cutting blade extends into said interior of said insertion portion.

5. The container of claim 4, wherein said sliding portion is slidable between a first position and a second position, wherein said cutting blade is extended into said bore of said insertion portion when said sliding portion is in said first position, wherein said bore of said insertion portion is positioned between said cutting blade and said end portion when said sliding portion is in said second position.

6. The container of claim 5, wherein said sliding portion is biased towards said second position, wherein a spring biases said sliding portion toward said second position.

7. A container for holding cigarettes, comprising:

a base portion, a top, a bottom and a perimeter side wall extending between said top and bottom of said base portion;

said perimeter side wall of said base portion having a pair of end panels and a pair of side panels extending between said end panels of said perimeter side wall;

said perimeter side wall of said base portion defining an interior space of said base portion adapted for holding cigarettes therein;

said top of said base portion having an opening into said interior space of said base portion, said opening of said top of said base portion having a generally rectangular periphery;

a lid portion substantially closing said opening of said top of said base portion, said lid portion being hingedly coupled to said base portion;

a cigarette cutting portion being extended from said bottom of said base portion, said cigarette cutting portion comprising a cutting blade and a sliding portion;

said cutting blade being extended from said bottom of said base portion;

said sliding portion having an end portion and an insertion portion;

said insertion portion of said sliding portion having an interior and a generally circular bore therethrough, said insertion portion being slidably inserted into said bottom of said base portion such that said cutting blade extends into said interior of said insertion portion;

sliding portion being slidable between a first position and a second position, wherein said cutting blade is extended into said bore of said insertion portion when said sliding portion is in said first position, wherein said bore of said insertion portion is positioned between said cutting blade and said end portion when said sliding portion is in said second position;

wherein said sliding portion is biased towards said second position, wherein a spring biases said sliding portion toward said second position;

said base portion having a length defined between said top and bottom of said base portion, said length of said base portion being greater than 2 inches;

said base portion having a width defined between said end panels of said perimeter side wall of said base, wherein said width of said base portion is greater than about 1 inch; and said base portion having a depth defined between said side panels of said perimeter side wall of said base, wherein said depth of said base portion is greater than about ½ inch.

8. The container of claim 4, wherein said perimeter side wall of said base portion has a pair of end panels and a pair of side panels extending between said end panels of said perimeter side wall, said base portion having a length defined between said top and bottom of said base portion, said base portion having a width defined between said end panels of said perimeter side wall of said base, and said base portion having a depth defined between said side panels of said perimeter side wall of said base.

9. The container of claim 8, wherein said length of said base portion is greater than 2 inches, wherein said width of said base portion is greater than about 1 inch, and wherein said depth of said base portion is greater than about ½ inch.

* * * * *